United States Patent [19]

Tsubuko et al.

[11] 4,360,580

[45] Nov. 23, 1982

[54] LIQUID DEVELOPER FOR USE IN ELECTROSTATIC PHOTOGRAPHY

[75] Inventors: Kazuo Tsubuko; Kenichi Matsubayashi; Tsuneo Kurotori, all of Tokyo, Japan

[73] Assignee: Ricoh Co., Ltd., Tokyo, Japan

[21] Appl. No.: 152,060

[22] Filed: May 20, 1980

Related U.S. Application Data

[63] Continuation of Ser. No. 851,986, Nov. 16, 1977, abandoned.

[30] Foreign Application Priority Data

Dec. 2, 1976 [JP] Japan ..... 51-144927

[51] Int. Cl.[3] ..... G03G 9/12

[52] U.S. Cl. ..... 430/137; 430/114; 430/11 S

[58] Field of Search ..... 430/114, 11 S, 137

[56] References Cited

U.S. PATENT DOCUMENTS 3,909,433 9/1975 Gilliams et al. ..... 430/114

3,991,226 11/1976 Kosel ..... 430/114 X

*Primary Examiner*—John D. Welsh

*Attorney, Agent, or Firm*—Blanchard, Flynn, Thiel, Boutell & Tanis

[57] ABSTRACT

A liquid developer for use in electrostatic photography is prepared by blending in a carrier liquid having a high electric resistivity and a low dielectric constant, (1) a resin dispersion composition A comprising a polymer obtained from at least one kind of resin which is difficult to dissolve or insoluble in said carrier liquid and at least one kind of monomer in which said resin is soluble and (2) a coloring agent having a high electric resistivity and consisting essentially of fine particles of pigment coated with a resin B which is different from said resin-dispersion composition A and is substantially insoluble in said carrier liquid. The liquid developer is superior in dispersion stability, polarity controlling property, adhesive property and storage stability and contributes to effecting development manifesting improved fixability as well as transferability.

26 Claims, No Drawings

LIQUID DEVELOPER FOR USE IN ELECTROSTATIC PHOTOGRAPHY

This is a continuation of application Ser. No. 851,986, filed Nov. 6, 1977, now abandoned.

BACKGROUND OF THE INVENTION (a) Field of the Invention

The present invention relates to a liquid developer for use in electrostatic photography which developer is of the type composed of a toner dispersed in a carrier liquid having a high electric resistivity and a low dielectric constant.

(b) Description of the Prior Art

Liquid developers for use in electrostatic photography are generally prepared by dispersing a toner consisting of a coloring agent such as carbon black and a synthetic resin like acrylic resin, phenol-modified alkyd resin, rosin, synthetic rubber, etc. or a natural resin as the principal ingredients, with the addition of a polarity controlling agent such as lecithin, metallic soap, linseed oil, higher fatty acid, etc. in a carrier liquid consisting of a non-aqueous solvent having a high insulating property and a low dielectric constant such as an aliphatic hydrocarbonaceous solvent.

In the case of such conventional liquid developers, however, because the resin and/or the polarity controlling agent separate and diffuse in the carrier liquid with the passing of time, the polarity becomes indistinct. Further, because the pigments contained therein undergo intensive secondary agglomeration which renders it difficult to reduce them to primary particles even by a commercial particle size reducing means such as a ball mill, attriter, ultrasonic disperser, etc., they are exposed on the surfaces of the toner particles, which causes lack of uniformity in the polarity controlling property of the particles. As a result, the transferability is poor, the image density is low, and the uniformity of solid image area, the sharpness and the resolving power become insufficient.

Besides, because the fixability of the toner is poor, these developers are hard to fix particularly on a slick paper with high smoothness. Further, because of their being poor in dispersion stability, they are apt to give rise to agglomeration of the toner which would render it impossible to use them over a long period of time.

SUMMARY OF THE INVENTION

The present invention is intended to provide a liquid developer for use in electrostatic photography which overcomes the aforementioned drawbacks of the prior art.

A principal object of the present invention is to provide a liquid developer for use in electrostatic photography which developer is superior in dispersion stability and polarity controlling property so that it does not cause secondary agglomeration of pigments and accordingly it is possible to effect development so as to achieve high transferability and improve the uniformity of the solid image area and the sharpness and resolving power of the image.

Another object of the present invention is to provide a liquid developer for use in electrostatic photography which developer is so superior in its adhesive property that it is possible to effect development so as to achieve enhanced fixability of the toner.

A further object of the present invention is to provide a liquid developer for use in electrostatic photography which developer prevents the occurrence of agglomeration of the toner and manifests an enhanced storage stability over a long period of time.

DETAILED DESCRIPTION OF THE INVENTION

The coloring agent used in the present invention, which consists essentially of fine particles of pigment coated with the resin B, has an average particle diameter ranging from 0.01 to 20 microns, preferably 0.1 to 1 micron, and the coloring agent has a high electric resistivity of about $10^8$ to $10^{14}$ Ωcm. The resin B is a resin which is substantially insoluble (to wit, totally insoluble or having a very low solubility) in the carrier liquid. The pigment used in the coloring agent of the present invention can include carbon black, various organic pigments and mixtures thereof. The carbon black pigment includes furnace black, acetylene black, channel black, etc. sold under the trademarks Pintex G, Special Black 14, Special Black 4, Special Black 4-B (the foregoing are products of Degusa Inc.), Mitsubishi #44, Mitsubishi #33, MA-11, MA-100 (the foregoing are products of Mitsubishi Carbon K.K.), Rarven 30, Rarven 40 and Conductex SC (the foregoing are products of Cabot Inc.). Other suitable pigments include organic pigments such as Phthalocyanine Blue, Phthalocyanine Green, Sky Blue Lake, Rhodamine Lake, Malachite Green Lake, Methyl Violet Lake, Peacock Blue Lake, Naphthol Green B Lake, Naphthol Green Y Lake, Naphthol Yellow S Lake, Lithol Fast Yellow 2G, Permanent Red 4R, Brilliant Fast Scarlet Lake, Hansa Yellow, Benzidine Yellow, Lithol Red, Lake Red C, Lake Red D, Brilliant Carmine 6B Lake, Permanent Red F5R, Pigment Scarlet 3B and Bordeaux 10B.

As mentioned above, the present invention does not employ a dye, but rather employs a pigment in the preparation of the coloring agent. The reason is that the pigment can exhibit superior properties such as the fading property and the dispersibility of the coloring agent in the developer, and besides can obtain a high-concentration image as compared with the dye. In the present invention, moreover, a coloring agent which is coated with any resin may be added to the coloring agent which has been coated with the resin B. In this case, it is still necessary to employ not a dye but rather a pigment.

Because the coloring agent of the present invention consists essentially of fine particles, there can be obtained an image of improved quality. Further, because the resin B is substantially insoluble in the carrier liquid, the coloring agent does not easily agglomerate, that is, it is superior in dispersibility, whereby the liquid developer possesses improved storage stability. Still further, because the coloring agent of the present invention possesses a high electric resistivity, its hygroscopicity is lower than conventional coloring agents for toners, which further improves the storage stability of the coloring agent per se. It is difficult to obtain a coloring agent all of whose particles are completely coated with the resin B. However, when the coating is conducted so as to coat the pigment particles as completely as possible, the electric resistivity of the coloring agent can be maintained at a high level. Therefore, the coloring agent employed in the present invention is preferably one coated to as complete an extent as possible. That is, the coloring agent is preferably in the state in which the pigment particles have been coated almost completely with the resin B. The words "almost completely" used herein to describe the amount of coating of the pigment particles with the resin B means that when the coloring agent particles are viewed under a microscope, it is observed that the major portions of said pigment particles are not exposed and/or that even if the coating of the particles with the resin B is not complete, still only a small portion of the total surface areas of the pigment particles is exposed and the remainder thereof is coated with an adhering coating layer of the resin B, whereby the electric resistivity of the coloring agent per se in the range of from $10^8$ to $10^{14}$ Ωcm.

As above-stated, the coloring agent of the present invention is in the state in which the pigment particles have been coated almost completely with the resin B. But, when the thus coated coloring agent is kneaded with other components in preparing the developer of the present invention, part of the coated layer of the resin B, on the occasion of kneading, sometimes falls off from the pigment particles. The so obtained coloring agent, even if part of the coated layer of the coloring agent falls off, still exhibits superior performances as compared with conventional coloring agents for use in liquid developers. Thus, the developer of the present invention, which contains the aforementioned coloring agent particles, possesses characteristics which are not possessed by conventional developers. In particular the present developer, into which it is difficult to inject the charge of the latent image, is so durable that a multiplicity of copies can be produced with little deterioration in the image density; the polarity of the developer remains unchanged even after repeated reproduction procedures; it exhibits an excellent transferability without requiring that a large quantity of the carrier liquid be contained in the image at the time of transferring; the thus transferred image exhibits a superior fixability when dried; and so forth.

The process for preparing a coloring agent coated with the resin B according to the present invention can be any process which makes it possible to obtain a coloring agent having the aforementioned characteristics. As an example of such processes, there can be mentioned the so-called flushing process. This is a kind of kneading process which comprises thoroughly kneading a hydrated paste of pigment (water content: 40 to 90 wt.%) with a solvent solution of resin B thereby to replace the water surrounding said pigment by the resin solution, then removing therefrom the water and solvent to obtain a dry solid mass, and thereafter crushing the mass to obtain finely divided dry particles of the desired coloring agent. In this case, the pigment contained in the hydrated paste can be carbon black, organic pigment or mixture thereof. Further, in the flushing process, mixtures of pigments may be coated with the resin B in such manners as follows. For example, either a single hydrated pigment-containing paste can be kneaded with another pigment which is not in the form of a hydrated paste, or a hydrated pigment-containing paste can be kneaded with another hydrated pigment-containing paste. To cite an instance, 0.1 to 20 parts by weight of carbon black particles (not hydrated) can be kneaded with 1 part by weight of hydrated paste of an organic pigment.

The resin B for use in the coloring agent comprises resins which are substantially insoluble in the aliphatic hydrocarbons which are employed as the carrier liquid for the liquid developers. Examples of suitable resins B are natural resin-modified phenol resin, natural resin-modified maleic resin, dammar, copal, shellac, gum rosin, hardened rosin, ester gum, glycerin ester-modified maleic resin, etc. The amount of the resin B to be employed is suitably in the range of from 0.5 to 5 parts by weight per 1 part by weight of the sum total of the pigment or pigments employed (water-free basis), preferably 1 to 4 parts of resin B per 1 part of pigment.

Further, it is possible additionally to add to the pigment, in addition to the resin B, a polymerizable monomer, together with a polymerization initiator, in an amount of $1\times10^{-3}$ to 0.1 part by weight per 1 part by weight of the sum total of the pigment or pigments employed (water-free basis). In this case, said monomer polymerizes during the kneading process, whereby the polarity of the toner particles is controlled also by the resulting polymer, as well as by the effect of the pigments.

The monomer to be employed for this purpose is desirably a monomer whose polymer exhibits a polarity controlling property on the coloring agent. As such monomers, there can be used unsaturated carboxylic acids such as acrylic acid, methacrylic acid, fumaric acid, itaconic acid, crotonic acid, maleic acid, etc., and vinyl monomers such as 2-hydroxyethyl acrylate, 2-hydroxyethyl methacrylate, 2-hydroxypropyl acrylate, 2-hydroxypropyl methacrylate, glycidyl acrylate, glycidyl methacrylate, styrene, chlorostyrene, vinyl acetate, acrylonitrile, methacrylonitrile, acrylamide, methacrylamide, N-vinyl pyrrolidone, etc.

The developer of the present invention is prepared by dispersing a specific resin-dispersion composition A together with the above-described coloring agent in a non-aqueous solvent having a high insulating property and a low dielectric constant. The "specific resin dispersion composition A" herein means a composition comprising at least one kind of resin which is difficult to dissolve or is insoluble in said non-aqueous solvent and a polymer obtained from at least one kind of monomer in which said resin is soluble. In other words, the resin, which is substantially insoluble in the non-aqueous solvent, to be contained in the foregoing resin dispersion composition A acts as a dispersion stabilizer, and such a polymer as is capable of solvation with a non-aqueous solvent is generally small in particle diameter and has a specific gravity closely akin to the dispersion medium, so that it is satisfactory in dispersion stability and hard to agglomerate. Further, because this polymer capable of solvation has a dispersion stabilizing effect, polarity controlling effect and fixability, it can be well adsorbed to pigments such as carbon thereby to maintain a distinct polarity of the pigment within non-aqueous solvents and also can firmly adhere to paper, plastic plate, metal plate, etc. Moreover, in the case where it is used jointly with a wax-like substance or polyolefin in the aforementioned resin dispersion composition A, these substances are separated in the form of fine particles within the polymerization system by quenching and are dispersed within the foregoing polymer capable of solvation, whereby enhancement of the dispersing effect of the resulting developer is feasible.

As resins substantially insoluble in non-aqueous solvents, natural resins such as ester gum, hardened rosin, etc., and natural resin-modified thermo-setting resins such as natural resin-modified maleic resin, natural resin-modified phenol resin, natural resin-modified polyester resin, natural resin-modified pentaerythritol resin, etc. as well as epoxide resin with epoxide equivalent of 50 to 5000, are suitable. As said epoxide resin, cyclic aliphatic ester type epoxide resin, epoxide phenol resin, epoxide urea resin, epoxide polyamide, epoxide resin ester-melamine resin, etc. can be used within the range of epoxide equivalent of 50 to 5000.

The monomer constituting a polymer capable of solvation with non-aqueous solvents (hereinafter called "monomer A") includes substances expressed by the following general formula.

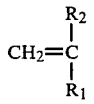

(wherein $R_1$ represents H or $CH_3$, $R_2$ represents $COOC_nH_{2n+1}$ or $OC_nH_{2n+1}$, and n is an integer ranging from 6 to 20)

To cite such monomers, there are stearyl, lauryl, 2-ethyl hexyl, hexyl and t-butyl esters of acrylic acid or methacrylic acid; cetyl methacrylate; octyl methacrylate; and vinyl stearate.

In the case where the resin substantially insoluble in non-aqueous solvents is a natural resin or a natural resin-modified thermo-setting resin, the monomer A can be further subjected to copolymerization with the following monomer (hereinafter called "monomer B"). As the monomer B for this purpose, there can be cited glycidyl methacrylate, glycidyl acrylate, propylene glycol monoacrylate, propylene glycol methacrylate, hydroxyethyl acrylate, acrylonitrile and methacrylonitrile.

In the case where the resin substantially insoluble in non-aqueous solvents is epoxide resin with epoxide equivalent of 50 to 5000, the monomer A can be further subjected to copolymerization with the following monomer (hereinafter called "monomer C"). This monomer C is supposed to esterify the epoxide radical within a synthetic resin through copolymerization with the monomer A, and it includes, for example, acrylic acid, methacrylic acid, itaconic acid, maleic acid, fumaric acid, etc. In either case of the foregoing resins substantially insoluble in non-aqueous solvents, the monomer A can be further subjected to copolymerization with a monomer D. As the monomer D for this purpose, there can be cited, for example, alkyl ester of acrylic acid or methacrylic acid having 1 to 4 carbon atoms, styrene, methyl styrene, vinyl acetate, etc.

In the case where the resin substantially insoluble in non-aqueous solvents is a natural resin or a natural resin-modified resin, the appropriate ratio of said resin to the monomer A (or a mixture of the monomer A and the monomer B and/or the monomer D) is in the range of 5–50:50–95 (by weight), and this can be modified in various ways according to the intended use of the final manufacture.

In the case where the resin substantially insoluble in non-aqueous solvents is epoxide resin with epoxide equivalent of 50 to 5000, the appropriate ratio of said resin to the monomer is in the range of 1–50:50–99 (by weight), but this can be suitably selected according to the intended use of the final manufacture. On the occasion of compounding the monomer A, monomer C and monomer D, the appropriate ratio thereof is in the range of 60–90:20–1:20–5 or thereabouts.

As afore-described, the non-aqueous solvent in which the coloring agent and the resin dispersion composition A is to be dispersed is one having a high insulating property and a low dielectric constant, and to cite applicable solvents, there are aliphatic hydrocarbons such as n-hexane, n-pentane, isododecane, isooctane, etc. (including commercial articles such as Isopar H, Isopar G, Isopar L and Isopar E manufactured by Exxon Co., Shellzole 71 manufactured by Shell Oil Co., etc.) and halogenated hydrocarbons such as carbon tetrachloride, perchloroethylene, etc.

Further, the resin dispersion composition A is obtained in the form of resin dispersion as polymerized within a non-aqueous solvent, but it is not always required that the non-aqueous solvent in the liquid developer be identical with the non-aqueous solvent at the time of polymerization.

Because the resin dispersion composition A is generally small in particle diameter and is superior in dispersion stability, polarity controlling property and adhesive property, and also because the coloring agent per se is in the state of primary particles as coated with the resin B as set forth above, a liquid developer prepared by dispersing such an ingredient has many advantages such that (1) the transferability is enhanced to about 75 to 90% from 50 to 60% in the conventional developers, the image density comes to be high, and the uniformity of the solid image area as well as the sharpness and resolving power of the image are improved, (2) the fixability is enhanced to about 70 to 78% from 50 to 65% in the conventional developers, and (3) the storage stability which has been in the range of from 3 to 6 months and the durability which has been about 10,000 copies in the conventional developers are enhanced to more than one year and more than 30,000 copies, respectively.

DESCRIPTION OF THE PREFERRED EMBODIMENTS

In the following liquid developers for use in electrostatic photography embodying the present invention, the coloring agents employed were as follows.

Coloring agent A:

| | |
|---|---|
| water | 500 g |
| Special Black | 30 g |

The foregoing ingredients were first thoroughly stirred by means of a flusher. Thereafter, upon adding 600 g of Beckasite P-720 (a 10% toluene solution) to the flusher, the contents thereof were further kneaded. Next, by removing the water and the solvent under reduced pressure by applying heat, a mass of coloring agent having a water content of 0.92% was obtained.

This mass was then crushed into a powder having a mean particle diameter of 0.1 to 0.2 micron by means of a stone mill.

Coloring agents B through D:

Three varieties of coloring agents were prepared by varying the materials therefor as shown in the following Table-1, through the same procedures as in the case of the coloring agent A.

TABLE 1

| Coloring agent | carbon black | organic pigment | resin |
|---|---|---|---|
| B | MA-100 | Peacock Blue Lake 50 g | Beckasite-1126 800 g |
| C | Conductex | Bril- | Harimack |

TABLE 1-continued

| Coloring agent | carbon black | organic pigment | resin |
|---|---|---|---|
| | SC 50 g | liant 50 g Carmine 6B | M-135G 900 g |
| D | Printex G 30 g | Alkali 20 g Blue | styrene-butadiene 15 g copolymer shellac 700 g |

Coloring agent E:

| | |
|---|---|
| water | 560 g |
| Carbon MA | 25 g |
| Phthalocyanine Blue (water content: 70%) | 30 g |

The foregoing ingredients were first thoroughly stirred by means of a flusher. Thereafter, upon adding 700 g of shellac (a 10% butanol solution), 5 g of methacrylic acid and 0.1 g of a zobisisobutyronitrile to the flusher, the contents thereof were kneaded for 4 hours while maintaining the flusher at a temperature of 150° C. Next, by removing the residual water together with the solvent under reduced pressure by applying heat, a mass of coloring agent having a water content of 0.80% was obtained. This mass was then crushed by means of a hammer mill whereby a powder of coloring agent having a mean particle diameter of 0.1 to 0.3 micron was obtained.

Coloring agent F:

By using N-vinyl pyrrolidone, 2-hydroxyethyl methacrylate, glycidyl methacrylate, itaconic acid and vinyl acetate, respectively, in lieu of methacrylic acid used in the preparation of the coloring agent D, varieties of powdery coloring agents were prepared.

Next, the resin dispersion compositions A employed for the present liquid developers for use in electrostatic photography were prepared as follows.

Resin dispersion composition A:

300 g of isooctane were put in a receptacle and heated up to a temperature of 90° C. Meanwhile, in 200 g of stearyl methacrylate and 5 g of glycidyl methacrylate were dissolved 50 g of Beckasite J8111, and further 0.2 g of lauryl dimethylamine, 0.2 g of hydroquinone and 2 g of benzoyl peroxide were mixed in the resulting solution. Next, after effecting polymerization by adding this mixture solution dropwise to the contents of said receptacle over a 2.5 hours' period, the polymerized contents were subjected to about 11 hours' heating at a temperature of 90° C., whereby a resinous dispersion containing 46.8% of solids was prepared.

Resin dispersion composition B:

Through the same procedures as in the preparation of the resin dispersion composition A excepting that 25 g of ORLIZON 705 were dissolved in 300 g of Isopar H and the receptacle (temperature: 90° C.) was quenched with cooling water upon completion of polymerization, a polyethylene-containing resinous dispersion with 47.1% of solids was prepared.

Resin dispersion composition C:

300 g of isooctane were put in a receptacle and heated up to a temperature of 90° C. Meanwhile, 100 g of Beckasite J896 were dissolved in a blended monomer consisting of 200 g of 2-ethyl hexyl methacrylate and 10 g of glycidyl methacrylate, and further 2 g of benzoyl peroxide were mixed in the resulting solution. Next, after subjecting the contents of said receptacle to polymerization by adding this mixture solution dropwise thereto over a 3 hours' period and further maintaining the same at said temperature in order to complete the reaction, 1 g of lauryl dimethylamine, 3 g of methacrylic acid and 0.1 g of hydroquinone were added to the thus polymerized contents, and reaction was effected at a temperature of 90° C. for 18 hours. Subsequently, after adding 500 g of isooctane to this reaction system, by further adding a mixture consisting of 50 g of methyl methacrylate and 3 g of benzoyl peroxide dropwise thereto and completing the reaction, a resinous dispersion with 28.4% of solids was prepared.

Resin dispersion composition D:

300 g of Isopar G were put in a receptacle and heated up to a temperature of 90° C. Meanwhile, 50 g of Pentasite P-423 were dissolved in a blended monomer consisting of 200 g of stearyl methacrylate and 5 g of glycidyl methacrylate, and further 0.1 g of hydroquinone and 1 g of lauryl dimethylamine were mixed in the resulting solution. The thus prepared mixture solution was added to the contents of said receptacle dropwise over a 4 hours' period, and additional 15 hours' reaction was effected at a temperature of 90° C. Thereafter, by adding thereto a mixture consisting of 50 g of methyl methacrylate and 4 g of azobisisobutyronitrile dropwise over a 3 hours' period at a temperature of 90° C. and completing the reaction, a resinous dispersion with 28.4% of solids was prepared.

Resin dispersion composition E:

Through the same procedures as in the preparation of the resin dispersion composition D excepting that the use of 50 g of methyl methacrylate was omitted in effecting the reaction, a resinous dispersion was prepared.

Resin dispersion composition F:

70 g of lauryl methacrylate and 10 g of glycidyl methacrylate were put in a receptacle, and 20 g of Beckasite F-231 were dissolved therein. After adding 1.5 g of benzoyl peroxide to the resulting solution while heating at a temperature of 90° C. and subjecting the mixture solution to polymerization for 8 hours, by further adding 100 g of Isopar H, a resinous dispersion with 50% of solids was prepared.

By dispersing the coloring agents subjected to the flushing process as above and the resin dispersion compositions in the non-aqueous solvents specified in the following Table-2, varieties of liquid developers for use in electrostatic photography according to the present invention were prepared.

TABLE 2

| | Coloring agent (g) | Resin-dispersion composition (g) | Non-aqueous solvent (g) | Dispersin means | Time for dispersing (hr) | Liquid developer (g/l) |
|---|---|---|---|---|---|---|
| Example 1 | A (120) | A (100) | Isopar H (300) | ball-mill | 28 | 20 |
| Example 2 | B (50) | B (100) | Isopar H (300) | ball-mill | 28 | 40 |
| Example 3 | C | C | n-hexane | ball-mill | 28 | 35 |

TABLE 2-continued

| | Coloring agent (g) | Resin-dispersion composition (g) | Non-aqueous solvent (g) | Dispersin means | Time for dispersing (hr) | Liquid developer (g/l) |
|---|---|---|---|---|---|---|
| | (60) | (100) | (300) | | | |
| Example 4 | D (30) | D (100) | n-hexane (300) | attriter | 8 | 18 |
| Example 5 | E (50) | E (100) | isooctane (300) | attriter | 8 | 20 |
| Example 6 | F (180) | F (100) | isooctane (200) | attriter | 8 | 30 |

When the respective characteristics of the liquid developers shown in Table-2 were measured, the results were as shown in Table-3 below.

TABLE 3

| | Example | | | | | |
|---|---|---|---|---|---|---|
| | 1 | 2 | 3 | 4 | 5 | 6 |
| Image density | 1.20 | 1.20 | 1.30 | 1.21 | 1.22 | 1.20 |
| Fixability (%) | 72 | 70.8 | 73 | 73 | 72 | 76 |
| Storage stability (gear) | 1 | 1 | 1 | 1.5 | 1 | 1.5 |
| Durability (copy) | 33,000 | 36,000 | 38,000 | 32,000 | 42,000 | 32,500 |

What is claimed is:

1. A liquid developer comprising: a carrier liquid having a high electric resistivity and a low dielectric constant; coloring agent particles dispersed in said carrier liquid, said coloring agent particles consisting essentially of organic pigment particles substantially completely coated with a dry coating of first resin which is substantially insoluble in said carrier liquid, said coloring agent particles having an average particle diameter in the range of from 0.01 to 20 microns and having an electric resistivity of about $10^8$ to $10^{14}$ Ωcm; a resin dispersion composition dispersed in said carrier liquid, said resin dispersion composition having been prepared by mixing (a) a solution of second resin dissolved in first monomer, with (b) a non-aqueous organic liquid having a high electric resistivity and a low dielectric constant, said second resin being substantially insoluble in said non-aqueous organic liquid, said first monomer being capable of forming a first polymer which is solvated by said non-aqueous organic liquid, and then subjecting the mixture of (a) and (b) to polymerizing conditions to polymerize said first monomer to form said resin dispersion containing said first polymer, said first polymer being adsorbed to said pigment to maintain a distinct polarity of said pigment and to make same fixable to a substrate, and said second resin acting as a dispersion stabilizer.

2. A liquid developer according to claim 1, wherein each of said carrier liquid and said non-aqueous organic liquid is selected from the group consisting of aliphatic liquid hydrocarbons and halogenated aliphatic liquid hydrocarbons.

3. A liquid developer according to claim 1, wherein said coloring agent particles have been prepared by kneading an aqueous paste of said pigment particles with an organic solvent solution of said first resin to replace the water around said pigment particles by said organic solvent solution of said first resin, then removing said water and said solvent to obtain a dry solid mass and then crushing said mass.

4. A liquid developer according to claim 1, in which said first resin is selected from the group consisting of natural resin-modified phenol resin, natural resin-modified maleic resin, dammar, copal, shellac, gum rosin, hardened rosin, ester gum and glycerin ester-modified maleic resin, and the amount of said first resin is from 0.5 to 5 parts by weight per 1 part by weight of said pigment particles.

5. A liquid developer according to claim 3, in which said first resin additionally contains a second polymer prepared by incorporating in said aqueous paste during said kneading step from $1\times10^{-3}$ to 0.1 part by weight, per 1 part by weight of said pigment particles, of second monomer selected from the group consisting of unsaturated carboxylic acid monomer and vinyl monomer, together with a polymerization initiator, so that said second monomer polymerizes during said kneading step.

6. A liquid developer according to claim 5, in which said second monomer is selected from the group consisting of acrylic acid, methacrylic acid, fumaric acid, itaconic acid, crotonic acid, maleic acid, 2-hydroxyethyl acrylate, 2-hydroxyethyl methacrylate, 2-hydroxypropyl acrylate, 2-hydroxypropyl methacrylate, glycidyl acrylate, glycidyl methacrylate, styrene, chlorostyrene, vinyl acetate, acrylonitrile, methacrylonitrile, acrylamide, methacrylamide and N-vinyl pyrrolidone.

7. A liquid developer according to claim 3, in which said pigment consists of a mixture of an organic pigment and carbon black.

8. A liquid developer according to claim 7, containing from 2 to 20 parts by weight of carbon black per 1 part by weight of said organic pigment.

9. A liquid developer according to claim 1, in which said second resin is selected from the group consisting of natural resins, natural resin-modified thermosetting resins and epoxy resins having an epoxy equivalent of from 50 to 5000.

10. A liquid developer according to claim 9, in which said first monomer has the formula

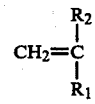

wherein $R_1$ is H or $CH_3$, and $R_2$ is $COOC_nH_{2n+1}$ or $OC_nH_{2n+1}$, and n is from 6 to 20.

11. A liquid developer according to claim 10, wherein said second resin is a natural resin or a natural resin-modified thermosetting resin.

12. A liquid developer according to claim 11, wherein said solution of said second resin in said first monomer additionally contains a third monomer selected from the group consisting of glycidyl methacrylate, glycidyl acrylate, propylene glycol monoacrylate, propylene glycol methacrylate, hydroxyethyl acrylate, acrylonitrile and methacrylonitrile, said third monomer being copolymerized with said first monomer so that said first polymer is a copolymer of said first monomer and said third monomer.

13. A liquid developer according to claim 11, wherein said solution of said second resin in said first monomer additionally contains a fourth monomer selected from the group consisting of alkyl esters of acrylic acid or methacrylic acid in which the alkyl has 1 to 4 carbon atoms, styrene, methyl styrene, vinyl toluene and vinyl acetate, said fourth monomer being copolymerized with said first monomer so that said first polymer is a copolymer of said first monomer and said fourth monomer.

14. A liquid developer according to claim 12, wherein said solution of said second resin in said first monomer additionally contains a fourth monomer selected from the group consisting of alkyl esters of acrylic acid or methacrylic acid in which the alkyl has 1 to 4 carbon atoms, styrene, methyl styrene, vinyl toluene and vinyl acetate, said fourth monomer being copolymerized with said first and third monomers so that said first polymer is a copolymer of said first monomer, said third monomer and said fourth monomer.

15. A liquid developer according to claim 11, wherein the weight ratio of said second resin:said first monomer is 5–50:50–95.

16. A liquid developer according to claim 12, wherein the weight ratio of said second resin:said first monomer plus said third monomer is 5–50:50–95.

17. A liquid developer according to claim 13, wherein the weight ratio of said second resin:said first monomer plus said fourth monomer is 5–50:50–95.

18. A liquid developer according to claim 14, wherein the weight ratio of said second resin:said first monomer plus said third monomer plus said fourth monomer is 5–50:50–95.

19. A liquid developer according to claim 10, wherein said second resin is an epoxy resin having an epoxy equivalent of from 50 to 5000.

20. A liquid developer according to claim 19, wherein said solution of said second resin in said first monomer additionally contains a fifth monomer selected from the group consisting of acrylic acid, methacrylic acid, itaconic acid, maleic acid and fumaric acid, said fifth monomer being copolymerized with said first monomer so that said first polymer is a copolymer of said first monomer and said fifth monomer.

21. A liquid developer according to claim 19, wherein said solution of said second resin in said first monomer additionally contains a fourth monomer selected from the group consisting of alkyl esters of acrylic acid or methacrylic acid in which the alkyl has 1 to 4 carbon atoms, styrene, methyl styrene, vinyl toluene and vinyl acetate, said fourth monomer being copolymerized with said first monomer so that said first polymer is a copolymer of said first monomer and said fourth monomer.

22. A liquid developer according to claim 20, wherein said solution of said second resin in said first monomer additionally contains a fourth monomer selected from the group consisting of alkyl esters of acrylic acid or methacrylic acid in which the alkyl has 1 to 4 carbon atoms, styrene, methyl styrene, vinyl toluene and vinyl acetate, said fourth monomer being copolymerized with said first and fifth monomers so that said first polymer is a copolymer of said first monomer, said fifth monomer and said fourth monomer.

23. A liquid developer according to claim 19, wherein the weight ratio of said second resin:said first monomer is 1–50:50–99.

24. A liquid developer according to claim 20, wherein the weight ratio of said second resin:said first monomer plus said fifth monomer is 1–50:50–99.

25. A liquid developer according to claim 21, wherein the weight ratio of said second resin:said first monomer plus said fourth monomer is 1–50:50–99.

26. A liquid developer according to claim 22, wherein the weight ratio of said second resin:said first monomer plus said fourth monomer plus said fifth monomer is 1–50:50–99, and the weight ratio of said first monomer:said fourth monomer:said fifth monomer is 60–90:20–1:20–5.

* * * * *